US008795402B1

(12) United States Patent
Mayfield et al.

(10) Patent No.: US 8,795,402 B1
(45) Date of Patent: Aug. 5, 2014

(54) FILTER AND FAN SYSTEM

(76) Inventors: Anthony E. Mayfield, Hext, TX (US); Kyle Mayfield, Hext, TX (US)

( * ) Notice: Subject to any disclaimer, the term of this patent is extended or adjusted under 35 U.S.C. 154(b) by 235 days.

(21) Appl. No.: 13/283,241

(22) Filed: Oct. 27, 2011

(51) Int. Cl.
*B01D 46/00* (2006.01)
*F24F 3/16* (2006.01)

(52) U.S. Cl.
CPC ..... *F24F 3/1603* (2013.01)
USPC ..... 55/471; 55/410; 55/481; 55/506

(58) Field of Classification Search
CPC ..... B01D 46/0005; F24F 2001/0096
USPC ..... 55/467, 471, 472, 473; 454/251
See application file for complete search history.

(56) References Cited

U.S. PATENT DOCUMENTS

| | | | | |
|---|---|---|---|---|
| 4,376,642 | A | 3/1983 | Verity | |
| 4,749,390 | A * | 6/1988 | Burnett et al. | 96/57 |
| D330,074 | S | 10/1992 | Wang et al. | |
| 6,527,838 | B2 | 3/2003 | Volo et al. | |
| 6,610,118 | B2 | 8/2003 | Bryce et al. | |
| 6,773,477 | B2 | 8/2004 | Lindsay | |
| 7,670,401 | B2 | 3/2010 | Whittemore | |
| 2003/0150326 | A1 | 8/2003 | Chasen | |
| 2008/0127830 | A1 | 6/2008 | Le et al. | |

* cited by examiner

*Primary Examiner* — Duane Smith
*Assistant Examiner* — Sonji Turner

(57) ABSTRACT

A filter and fan system having a fan with a first air intake component and an exhaust component, wherein air enters the fan via the air intake component and exits the fan via the exhaust component, a frame wherein the fan is housed, the frame has a first side and a second side, the first air intake component faces the first side, and a first track on the first side of the fan frame, an air filter is removably engaged in the first track, the air filter is in direct contact with the first air intake component and completely covers the first air intake component.

1 Claim, 4 Drawing Sheets

FRONT VIEW

SIDE VIEW

TOP VIEW

FILTER AND FAN SYSTEM

FIELD OF THE INVENTION

The present invention is directed to a fan system with filters for filtering and circulating air simultaneously.

BACKGROUND OF THE INVENTION

The present invention features a filter and fan system. The system of the present invention filters air while cooling (e.g., in the summer) or heating (e.g., in the winter). The system of the present invention allows for filtering and air circulation in one single unit.

SUMMARY

The present invention features a filter and fan system. In some embodiments, the filter and fan system comprises a fan having a first air intake component and an exhaust component, wherein air enters the fan via the air intake component and exits the fan via the exhaust component; a frame, the fan is housed in the frame, the frame has a first side and a second side, the first air intake component faces the first side; and a first track disposed on the first side of the fan frame, an air filter is removably engaged in the first track, the air filter is in direct contact with the first air intake component and completely covers the first air intake component.

In some embodiments, the exhaust component comprises adjustable vents.

In some embodiments, the filter and fan system further comprises a control button for changing a speed of the fan.

In some embodiments, the filter and fan system further comprises a second air intake component, the second air intake component faces the second side of the fan housing, and a second track is disposed on the second side of the fan frame, an air filter is removably engaged in the second track, the air filter is in direct contact with the second air intake component and completely covers the second air intake component.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
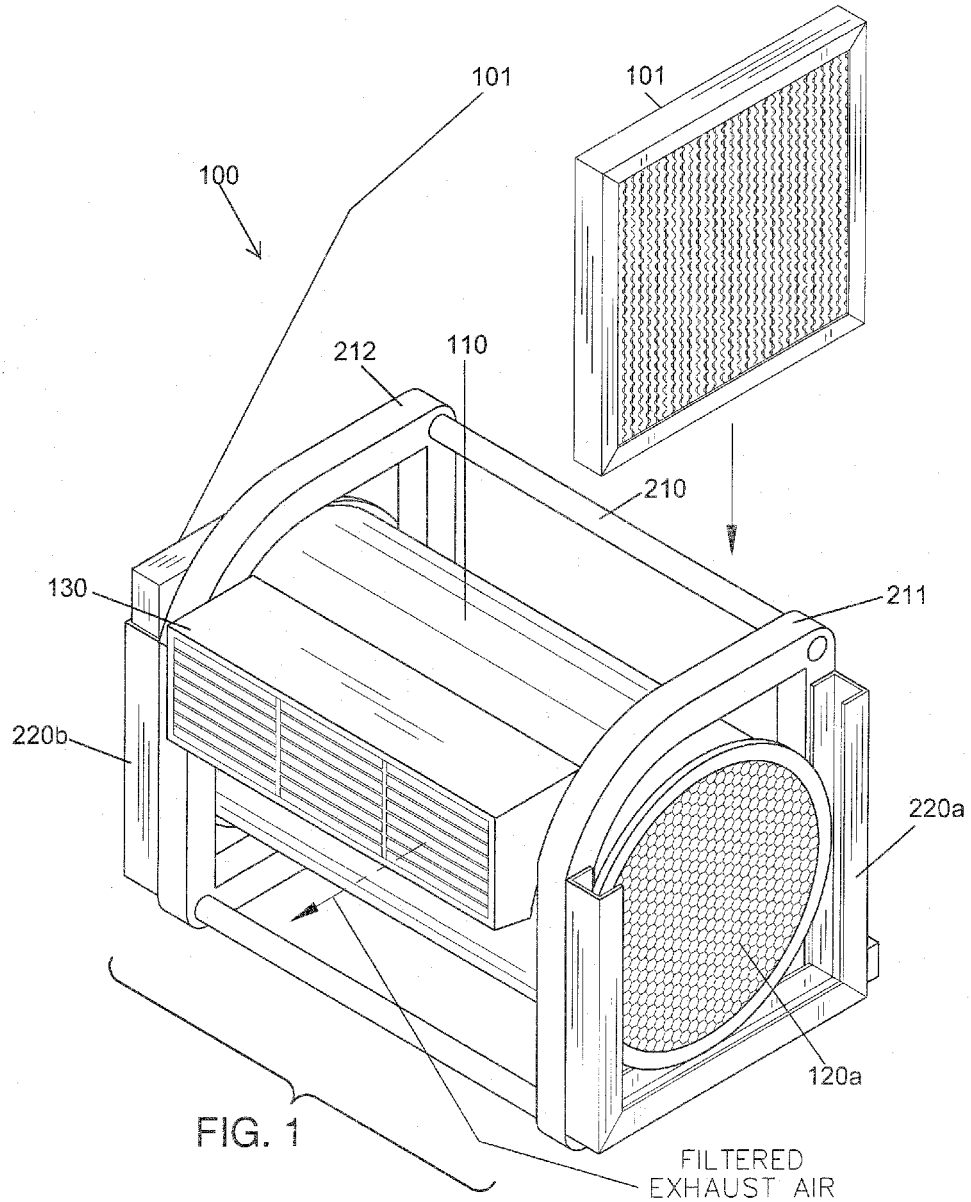
FIG. 1 is a perspective view of the filter and fan system of the present invention.
Figure 2:
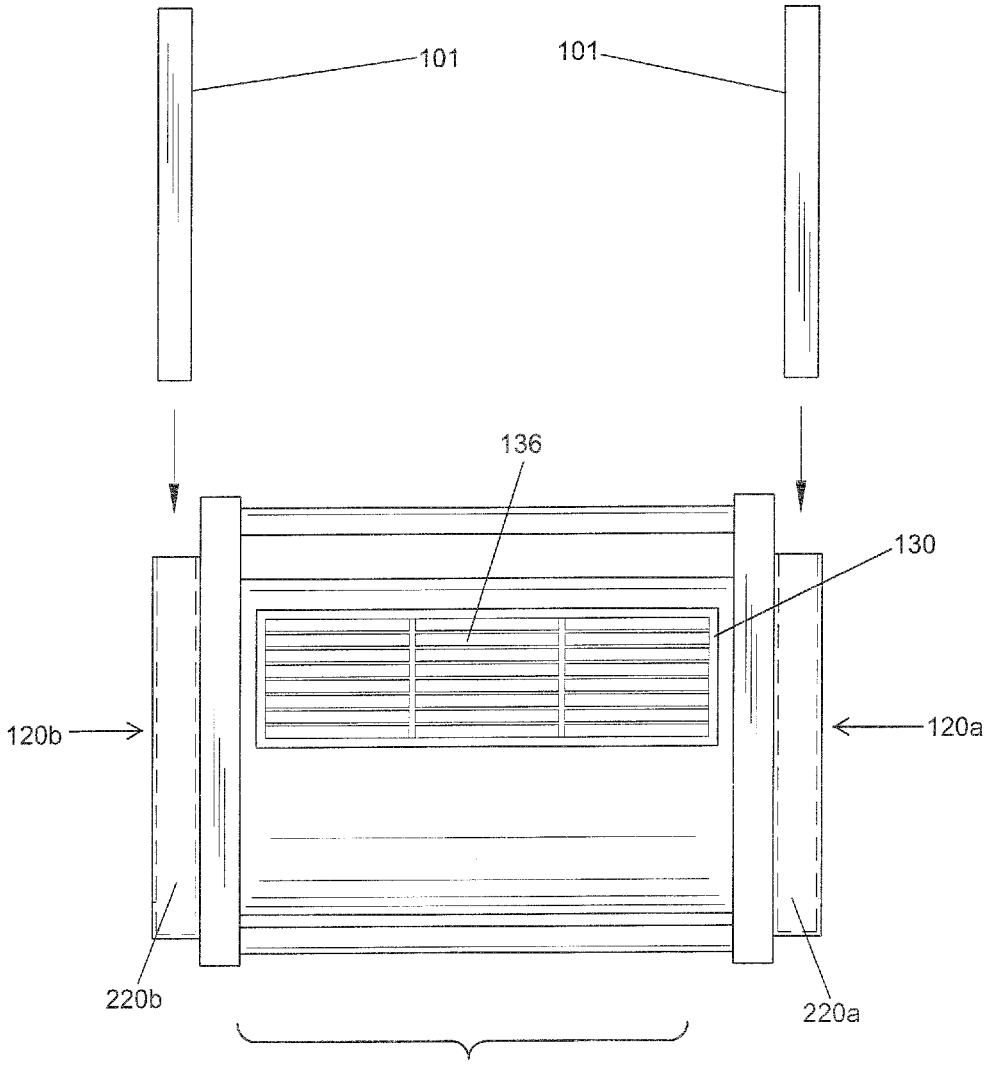
FIG. 2 is a front view of the filter and fan system of the present invention.
Figure 3:
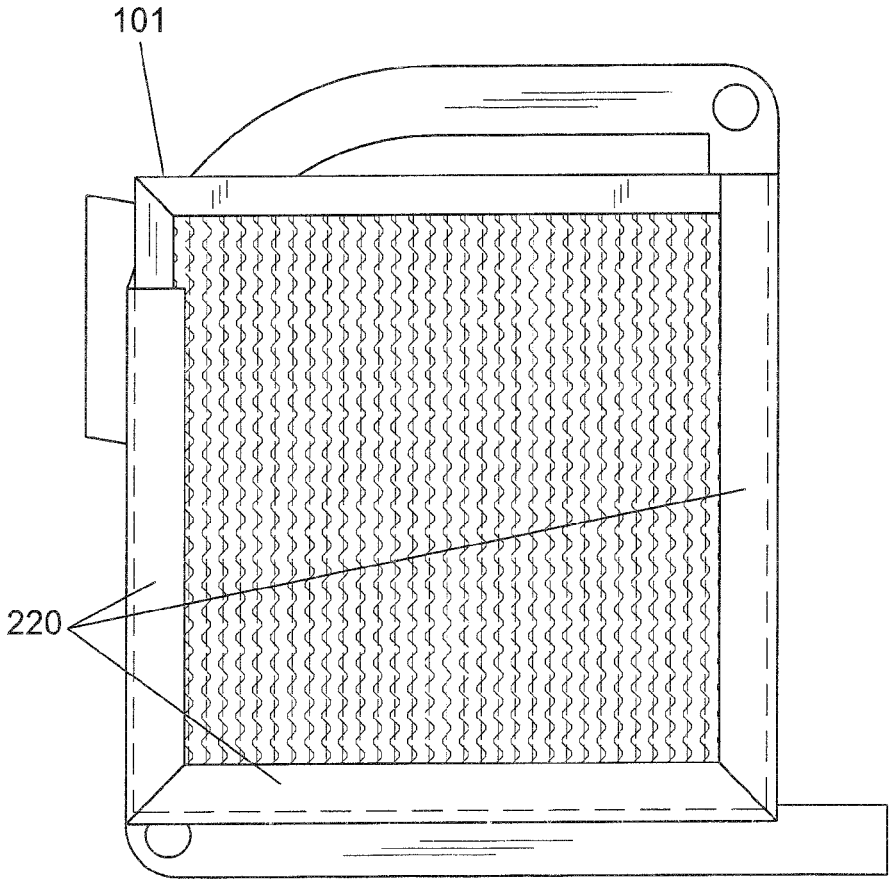
FIG. 3 is a side view of the filter and fan system of the present invention.
Figure 4:
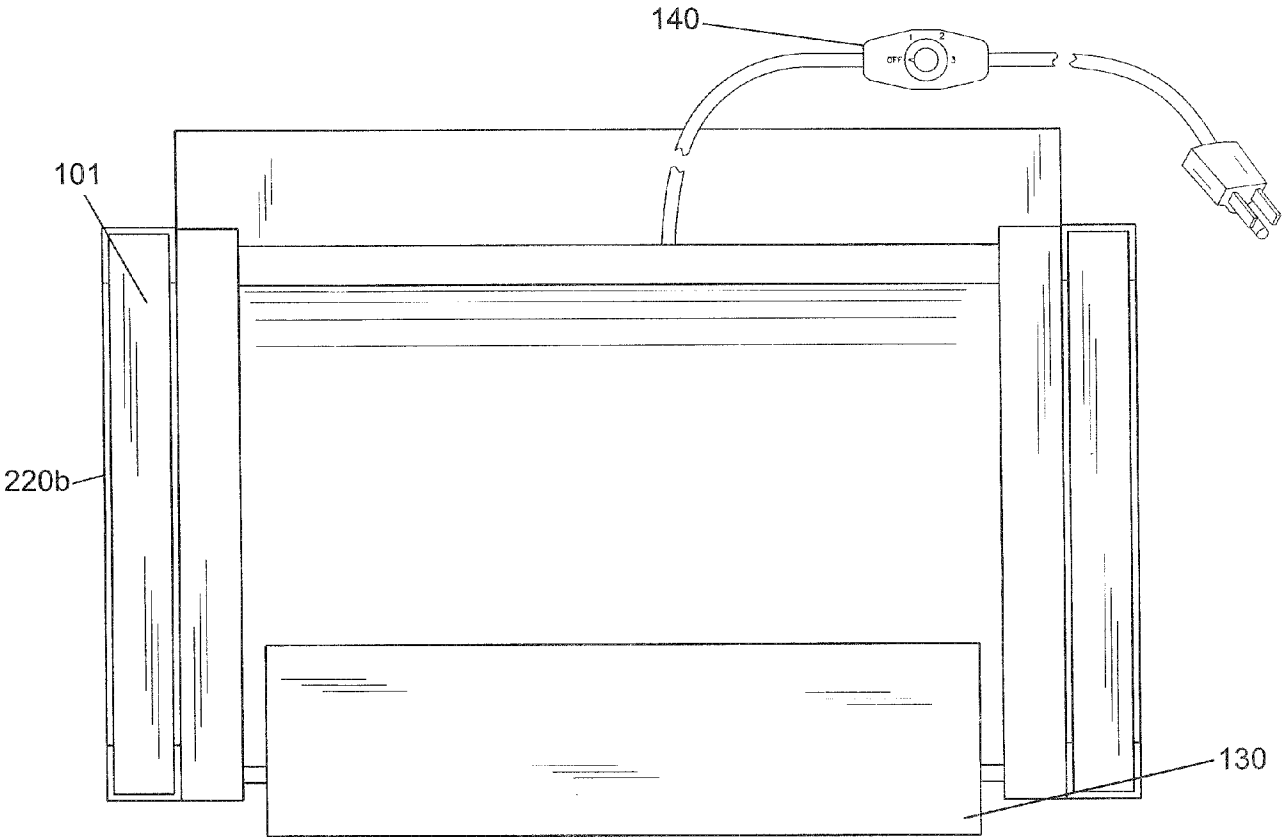
FIG. 4 is a top view of the filter and fan system of the present invention.

Referring now to FIG. 1-4, the present invention features a filter and fan system 100. The system 100 of the present invention comprises a fan 110 (e.g., air blower). The fan 110 resembles standard fans, which are well known to one of ordinary skill in the art. For example, the fan 110 has a first air intake component 120*a*. In some embodiments, the fan 110 has a second air intake component 120*b*. Air enters the fan 110 via the air intake components 120, and the air blown out of the fan 110 via an exhaust component 130. In some embodiments, the exhaust component 130 comprises adjustable vents 136. Adjustable vents are well known to one of ordinary skill in the art. In some embodiments, the fan 110 comprises a control button 140 (e.g., a switch) for changing the speed of the fan 110.

The fan 110 is housed in a fan frame 210. The fan frame 210 has a first side 211, wherein the first air intake component 120*a* faces the first side 211. The fan frame 210 has a second side 212, wherein in some embodiments, the second air intake component 120*b* faces the second side 212. A first track 220*a* is disposed on the first side 211 of the fan frame 210. In some embodiments, a second track 220*b* is disposed on the second side 212 of the fan frame 210. The tracks 220 are adapted to accept an air filter 101. Air filters are well known to one of ordinary skill in the art The air filters are adapted to catch dirt and dust, preventing the dirt and dust from entering into the fan 110. The tracks 220 are positioned such that the air filters are in direct contact with the respective air intake component 120 and the air filters 101 cover the entire portion of the respective air intake component 120.

In some embodiments, the tracks 220 are U-shaped, e.g., each track 220 has a horizontal bar and two vertical bars connected on the ends of the horizontal bar. The filters can slide through the vertical bars and engage the horizontal bar. Such tracks and configurations are well known to one of ordinary skill in the art.

Without wishing to limit the present invention to any theory or mechanism, it is believed that the system 100 of the present invention is advantageous because the system 100 filters air faster and thus allows for better air movement.

The disclosures of the following U.S. Patents are incorporated in their entirety by reference herein: U.S. Pat. No. 4,376,642; U.S. Design Pat. No. D330074; U.S. Pat. No. 6,527,838; U.S. Pat. No. 6,610,118; U.S. Pat. No. 6,773,477; U.S. Pat. No. 7,670,401; U.S. Patent Application No. 2003/0150326; U.S. Patent Application No. 2008/0127830.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A filter and fan system consisting of:

(a) a fan having a first air intake component and an exhaust component, wherein air enters the fan via the air intake component and exits the fan via the exhaust component, wherein the exhaust component consists of adjustable vents;

(b) a frame, the fan is housed in the frame, the frame has a first side and a second side, the first air intake component faces the first side; and (c) a first track disposed on the first side of the fan frame, an air filter is removably engaged in the first track, the air filter is in direct contact with the first air intake component and completely covers the first air intake component.

* * * * *